US006543491B1

(12) United States Patent
Chung

(10) Patent No.: US 6,543,491 B1
(45) Date of Patent: Apr. 8, 2003

(54) DESIGN PACKAGE FOR TEMPERATURE-CONTROLLED PACKAGING

(76) Inventor: Jing-Yau Chung, 13310 Pebblebrook, Houston, TX (US) 77079

( * ) Notice: Subject to any disclaimer, the term of this patent is extended or adjusted under 35 U.S.C. 154(b) by 0 days.

(21) Appl. No.: 09/705,090

(22) Filed: Nov. 2, 2000

Related U.S. Application Data

(60) Provisional application No. 60/163,532, filed on Nov. 4, 1999.

(51) Int. Cl.[7] ..... B65B 31/04
(52) U.S. Cl. ..... 141/65; 141/8
(58) Field of Search ..... 53/432, 433, 434; 206/524.8; 141/65, 82, 8; 220/592.11, 592.21, 592.24, 592.27

(56) References Cited

U.S. PATENT DOCUMENTS 4,550,046 A * 10/1985 Miller ..... 428/116
5,784,860 A * 7/1998 Fujikawa et al. ..... 53/434
5,875,613 A * 3/1999 Maskell ..... 53/434
6,161,695 A * 12/2000 Nicolais ..... 206/438

* cited by examiner

*Primary Examiner*—David J. Walczak
*Assistant Examiner*—Peter deVore
(74) *Attorney, Agent, or Firm*—Mark A. Oathout

(57) ABSTRACT

The temperature enclosed package, in one embodiment, has a reflector for surrounding the product, a frame with a cavity placed around the reflector, an insulating enclosure placed around the frame, and a diaphragm placed around the insulating enclosure. A vacuum is produced within the temperature controlled package.

2 Claims, 6 Drawing Sheets

DESIGN PACKAGE FOR TEMPERATURE-CONTROLLED PACKAGING

This application claims benefit to Provisional Application 60/163,532 filed Nov. 4, 1999.

BACKGROUND

In shipping a package, it often requires a proper temperature control of the object being packed and shipped. For example, frozen food samples are shipped from the present inventor's food manufacturing plant to our customers on a daily basis. These frozen samples require a good control of their packaged temperature in order to keep them frozen and fresh. The packaged temperature can be controlled externally using a refrigerated environment such as the refrigerated compartment of a "refer-truck". However, for a relatively small size shipment of samples, or other refrigerated products, for convenience and for economical reasons, we often ship the products through a common carrier without refrigeration facilities. A common method of shipping such product through a common carrier is to use a cold substance such as "dried ice" (solid carbon dioxide) to help maintain a frozen product temperature in addition to using a good insulator around the product along with the "dried ice".

SUMMARY OF THE INVENTION

The present invention involves (i) a new insulating package providing good insulation for a product using an ordinary insulating material without the need for using additional cold substances such as the "dried ice" mentioned above, and (ii) a device to prepare such a new package mentioned in (i). The present invention can also be used in conjunction with any other conventional packaging methods such as the one using the "dried ice", to enhance the result of maintaining the product temperature.

Generally speaking, heat is transferring from one object to another by one or more of the three well-known mechanisms, namely (i) conduction through a solid medium, (ii) radiation through space and (iii) convection through a fluid medium. Strictly speaking, convection and conduction are in the same heat transfer category. But conduction involves only a solid medium, while convection involves heat transfer through the "boundary layer" of a fluid medium at the vicinity of a solid, and is greatly affected by the "free stream velocity" of the medium. In convection, the "film coefficient of heat transfer" which is a function of the "free stream velocity", is used as the indicator of the transferability of conductive heat from a solid to a fluid or vice versa. The above mentioned transferability is zero in the absence of a fluid medium, namely in a vacuum. The "film coefficient of heat transfer" is equivalent to the "heat conductivity" in conduction. Heat radiation, however, is a different physical phenomenon involving the transferring of microscopic particles and wave from an object to another through space with or without a medium. In a macroscopic investigation of heat radiation, each object has its heat emission, absorption and reflection characteristics. The absorption and reflection characteristics, however, are strictly related to each other. The difference in the total emission and absorption between two given objects results in the net radiation heat transfer from one object to the other.

All three categories of heat transfer mentioned above have been taken into consideration in the present invention so that the overall heat transfer from outside the package to the packaged product or vice versa is minimized.

The temperature enclosed package, in one embodiment, has a reflector surrounding the product, a frame with a cavity placed around the reflector, an insulating enclosure placed around the frame, and a diaphragm placed around the insulating enclosure. A vacuum is produced within the temperature controlled package.

DETAILED DESCRIPTION OF THE PRESENT INVENTION

(1) The Temperature-controlled Package (a) Basic Embodiment

Figure 1:
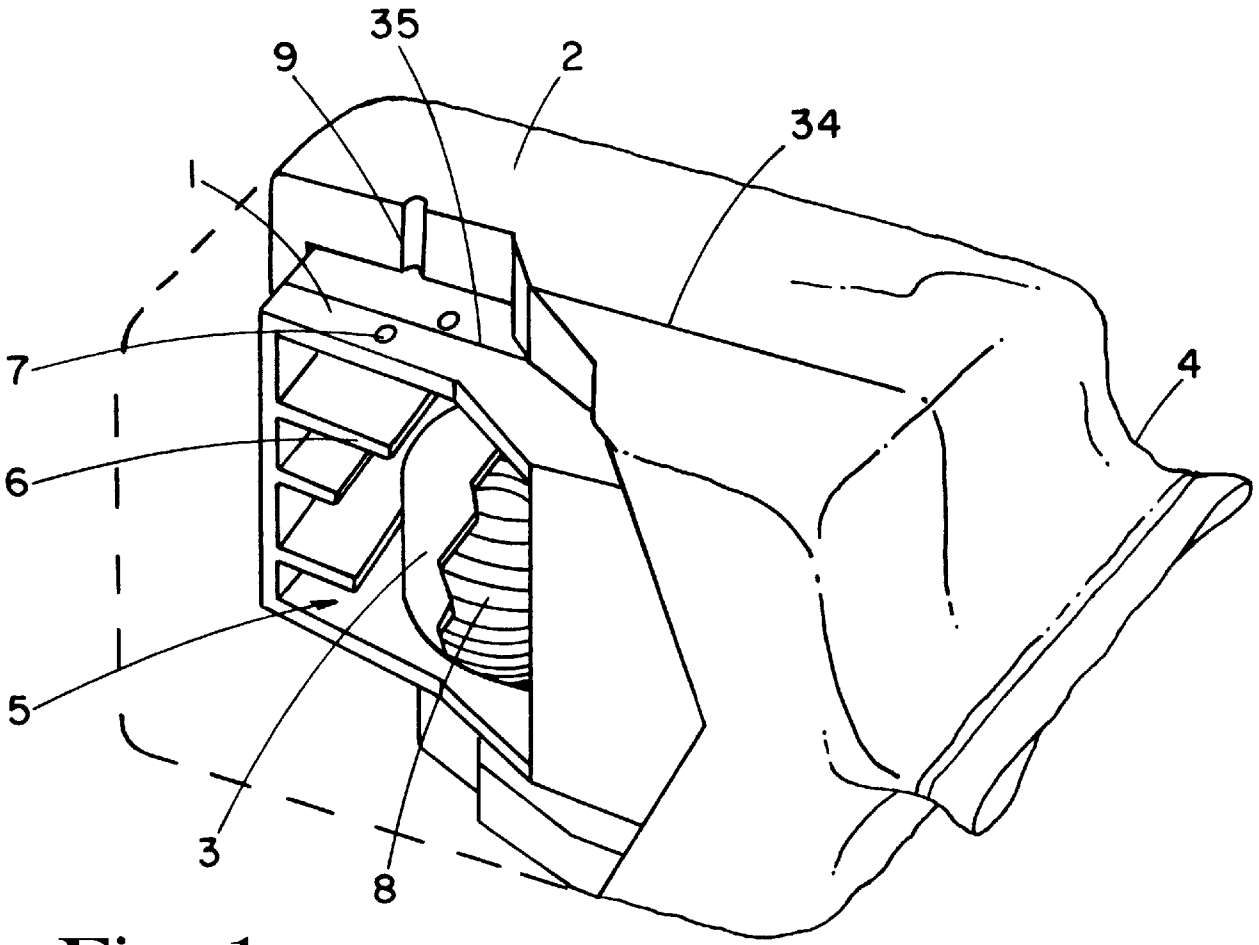
FIG. 1 is a perspective view, partially broken away, of an embodiment of the invention.
Figure 1A:
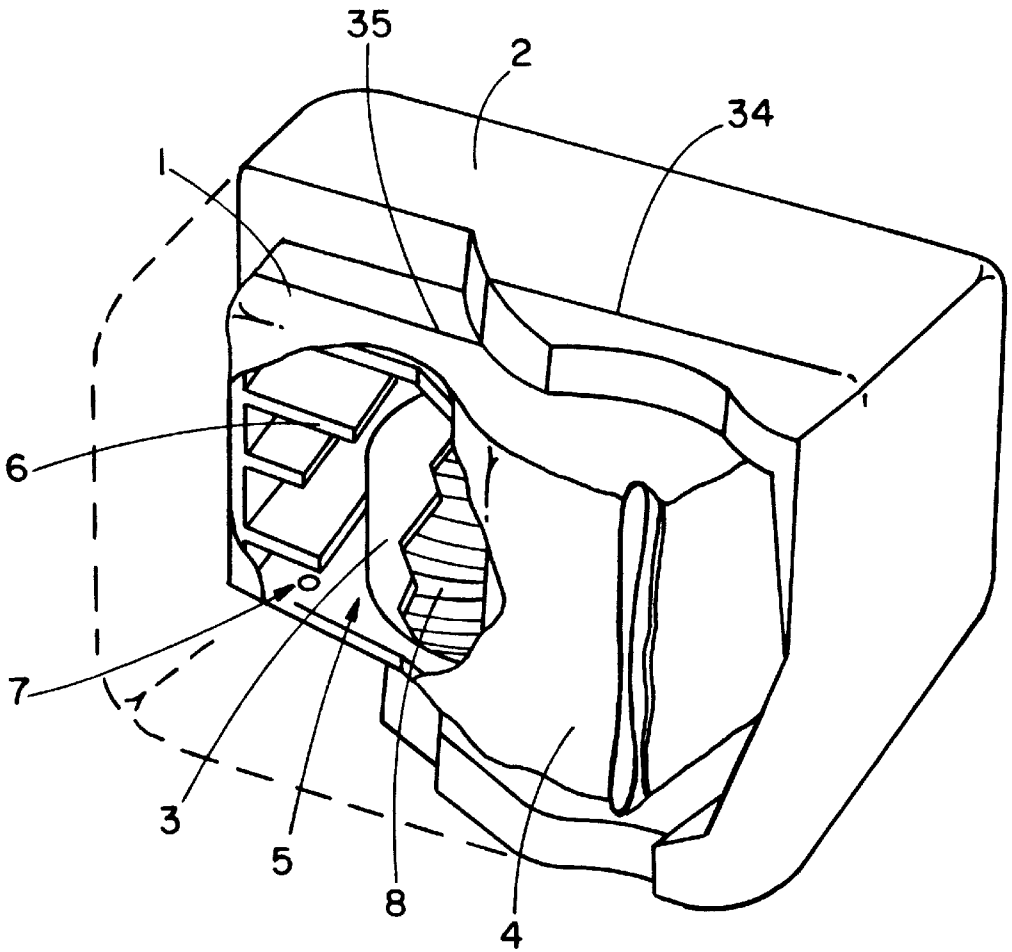

With reference to FIG. 1, the basic embodiment of the present invention consists of a package Frame 1, an insulating Enclosure 2, a Reflector 3, an airtight Diaphragm 4 and a vacuum Cavity 5. Frame 1 is made of a relatively rigid thin material such as a rigid plastic shell molded with structural Reinforcement 6 inside the shell as shown. A number of vacuum Hole 7 which is drilled through the plastic shell is also shown. The spatial gaps within the structural Reinforcement 6 along with the cavity in the central portion of package Frame 1 constitute Cavity 5. Frame 1 is covered by the insulating Enclosure 2 reducing heat conduction from outside the package to Frame 1. Typically, Enclosure 2 is made of a material with low heat conductivity such as Styrofoam or porous paper products. A number of vacuum Hole 9 is also drilled through Enclosure 2 providing air passages in the vacuum process described later in Section (2). Diaphragm 4 is made of an airtight flexible thin material such as a thin polyethylene sheet. Typically, Diaphragm 4 is a plastic bag, which covers the entire Enclosure 2 along with Frame 1, and is sealed at its opening after a vacuum is created in Cavity 5. Since Diaphragm 4 is airtight, it keeps the air from getting into Cavity 5 from outside the package. Thus Cavity 5 remains to be a vacuum. The relatively rigid structure of Frame 1 gives resistance to the atmospheric pressure exerting on Frame 1 through Enclosure 2 and provides proper package space at its central location. The Reflector 3 is made of a thin flexible material such as a plastic sheet with a high reflectivity on one side and is placed between Frame I and Product 8 which is at the central portion of Cavity 5. The high reflectivity side of Reflector 3 is facing towards Frame 1 in the case that heat transfer from outside the package is to be minimized. If in the case, heat is to be preserved in the package, the high reflectivity side should face towards the center of the package. As shown in FIG. 1, the lengths of Reinforcement 6 are made uneven. This gives less contact area between Frame 1 and Product 8 minimizing heat conduction from the Frame to the Product. In fact, for a lightweight Product 8, the contact area can be further reduced by using sharp edged reinforcement structures.

Enclosure 2 minimizes heat conduction due to its low heat conductivity. The arrangement of the contact area mentioned above also reduces the heat conduction from Frame 1 to Product 8, since the amount of heat conduction is proportional to the total cross sectional area through which, heat conduction occurs. The vacuum space in Cavity 5 minimizes heat convection. It should be noted that the vacuum can be designed to be at a desirable level optimizing the efficiency of insulation and the cost of creating the system, namely the cost of providing a relatively rigid Frame 1 and the cost of generating a relatively high vacuum. The Reflector 3 reduces heat radiation from Frame 1 towards Product 8, in the case the high reflectivity side of Reflector 3 faces towards the outside of the package. The effect is reversed when the high reflectivity side faces towards the center of the package.

It should be noted that both Frame 1 and Enclosure 2 could be made of two symmetrical pieces. The two pieces are pressed together by the atmospheric pressure to form the Frame and the Enclosure. Line 34 in FIG. 1 represents the contact line between the two parts of Enclosure 2 while Line 35 represents the contact line of the two parts of Frame 1.

(b)Embodiment with Diaphragm 4 Enclosing Frame 1 and Not Enclosing Enclosure 2.

In this embodiment, instead of placing the insulating Enclosure 2 inside Diaphragm 4, Enclosure 2 encloses Diaphragm 4 which contains Frame 1. This arrangement provides better protections to the diaphragm in shipping and handling, if no additional packaging box is used to enclose Enclosure 2. The overall insulation in this embodiment, however, is less efficient than that of embodiment (a). The inside surface of Enclosure 2, in this embodiment, can be made unevenly such that the contact area between Enclosure 2 and Diaphragm 4 is reduced. As a result, heat transfer is further reduced between the two elements. In this condition, part of the heat conduction at the vicinity of the contact area is replaced by the so-called free convection which is a less efficient heat transfer process than the original conduction. It should be noted that such uneven surface provides reduced resistance to the air pressure and can not be employed in embodiment (a), because it would not stand the atmospheric pressure exerting on Enclosure 2. An additional advantage of this embodiment is that it reduces the size of the Diaphragm, thus reducing the overall packaging material cost.

(c) Embodiment without Reinforcement 6 but with Spacer between Frame 1 and Product 8.

Figure 2:
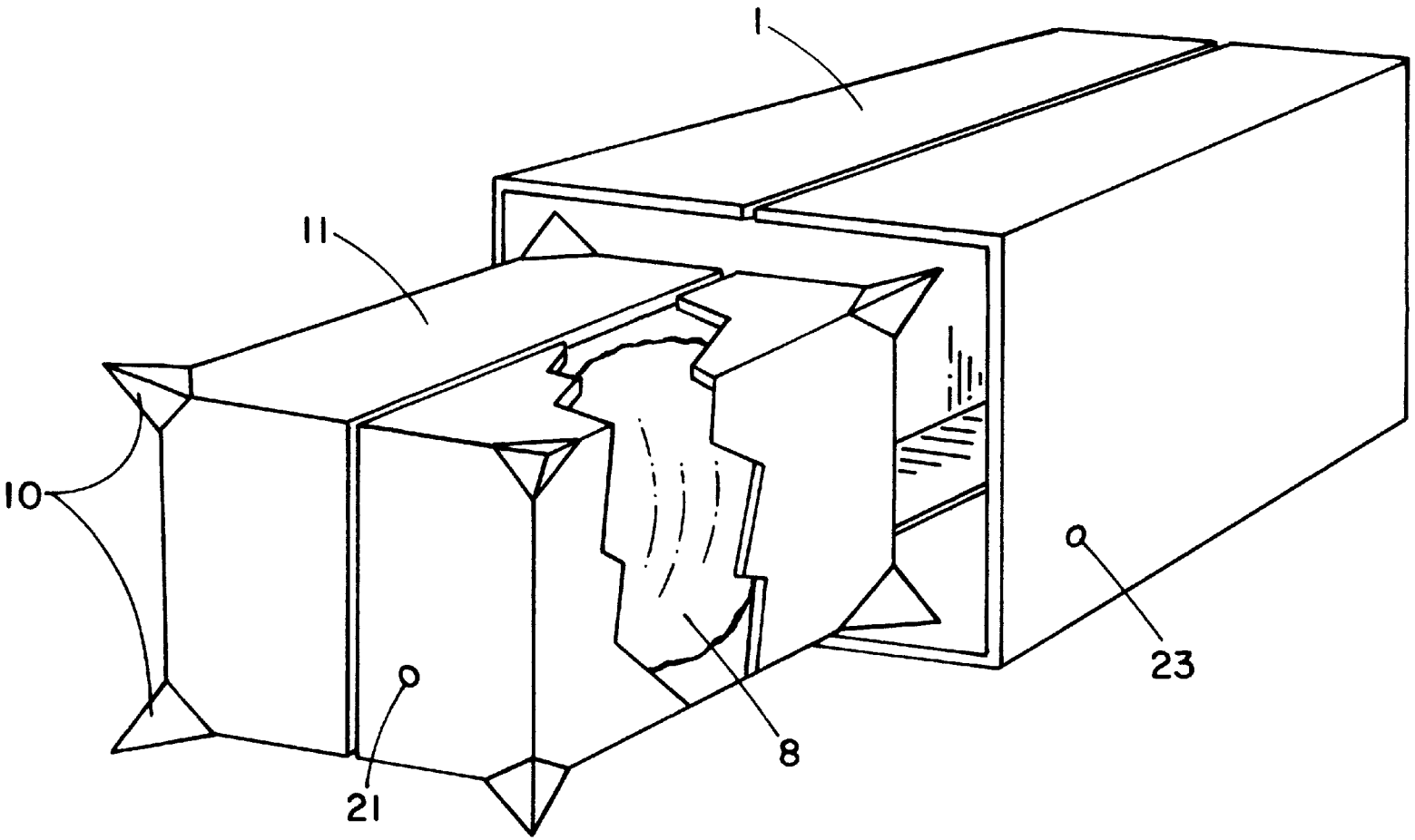
FIG. 2 is a perspective view, partially broken away, of an embodiment of the invention.

In this embodiment, Frame I is a shell made of a relatively hard material such as hard plastic, aluminum or wood etc., which are rigid enough to support themselves under an atmospheric pressure without a reinforcement structure such as Reinforcement 6. With reference to FIG. 2, Spacer 10 is used in this embodiment to create a vacuum space between Frame 1 and Compartment 11 which contains Product 8. Spacer 10 is rigidly connected to product Compartment 11. Spacer 10 can be made to have restricted contact points to Frame 1 to minimize the heat transfer. Shown in FIG. 2 is an example of this configuration where Spacer 10 has a total of eight small contact points to Frame 1. Each such contact point is located at the corner of a rectangular Compartment 11 pointing outward in the four diagonal directions as illustrated in the figure. The Compartment as well as the Frame can be made in any desirable shape depending on the applications. Generally speaking, however, a cylindrical shell provides better resistance to the pressure exerting on its outer surface. Hence it is a good configuration for the Frame. Since Compartment 11 is not subject to a high pressure from its outside surface towards its inside compartment or vice versa, it can be made of a lightweight insulating material such as Styrofoam. The overall distances between the contact points on Spacer 10 can be made slightly shorter than the corresponding distances between the contact points on Frame 1. Such a contact mechanism provides only a portion of the eight contact points, as in the example, to serve as the actual contact between Frame 1 and Compartment 11 at any given time. For lightweight Product 8, the contact points can be further reduced. Air passage Hole 21 and air passage Hole 23 are provided on Compartment 11 and Frame 1 respectively for drawing the air out of the cavities during the vacuum process. It should be noted that the rest of the embodiment such as the arrangement of the Enclosure 2, can be made to be the same as that of the basic embodiment discussed in (a) or the arrangement described in the embodiment (b).

It should be noted that in the embodiments described in (a), (b) and (c), multiple layers of enclosure with different insulating material may be employed for economical reason or for enhanced insulation or for both.

(2) The Device and Method of Generating a Vacuum Space in the Present Invention The vacuum space in Cavity 5 mentioned above is an essential element of heat insulation for the present invention. The vacuum in question can be generated by means of an existing vacuum machine that is used to package the so-called atmosphere-controlled food packages. An atmosphere-controlled food package, however, does not provide added heat insulation, because it does not provide the vacuum space mentioned in the present invention, although a vacuum is generally created within the product. Its sole purpose, however, is to reduce the oxygen content in the package, thus increasing its shelf life. The machine uses a vacuum chamber to draw air out of the package and it seals the package inside the chamber after the vacuum is created in the package. The same procedure of preparing the atmosphere-controlled package can be employed to prepare the package of the present invention using a commercially available vacuum machine provided the vacuum Cavity 5 described in Section (1) is properly created.

(a) A New Mechanical Vacuum Device

Figure 3:
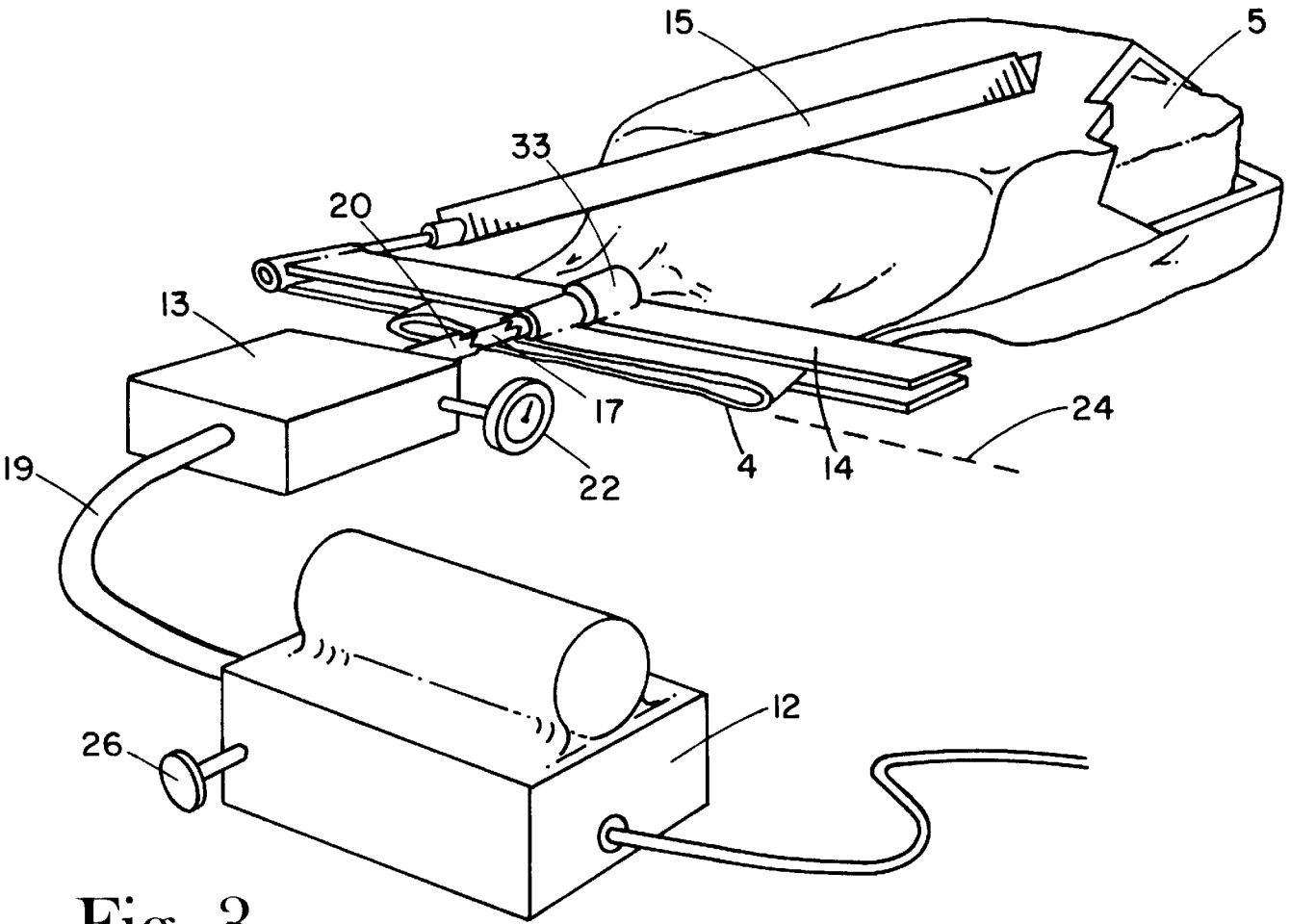
FIG. 3 is a perspective view, partially broken away, of devices used in implementing the invention.
Figure 4:
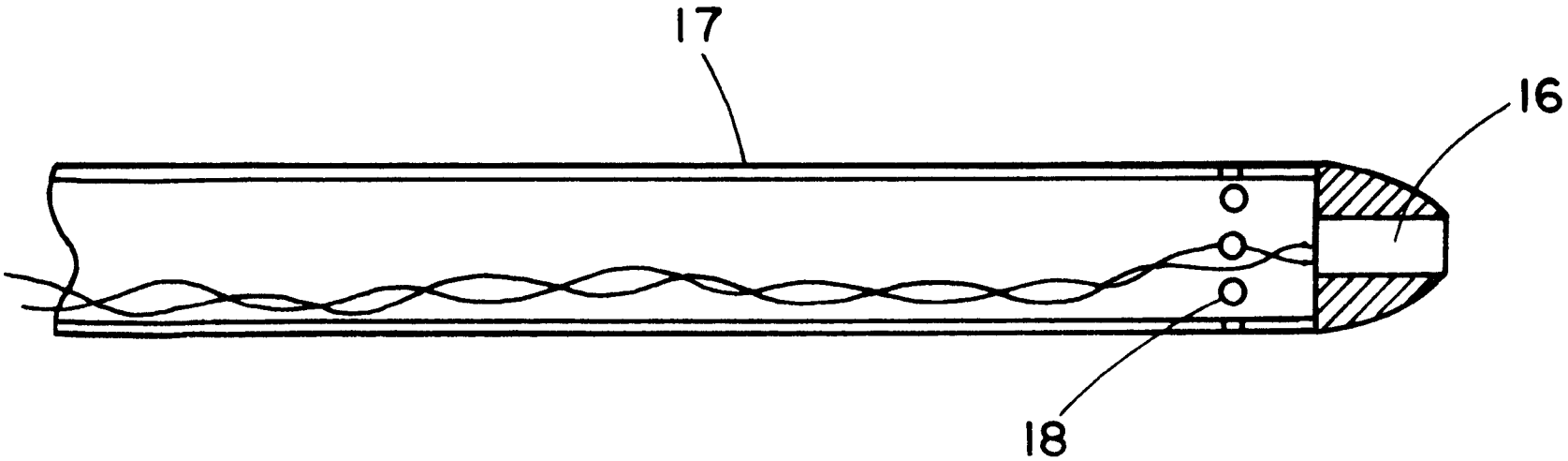
FIG. 4 is a sectional view of the suction tubing and pressure sensor.

With reference to FIG. 3, this new device consists of its major elements of a vacuum reservoir or a Vacuum Pump 12, a Suction System 13, a Clamp 14 and a Seal Bar 15. A Pressure Sensor 16 is built in the Suction System 13 at the tip of a rigid Suction Tubing 17 as depicted in FIG. 4. An electric wire connected to the Pressure Sensor 16 is running inside Suction Tubing 17 keeping the tubing smooth on its external surface. A few Suction Holes 18 behind the tip of the tubing and behind the Pressure Sensor 16 serve as air inlets to the Suction System 13. Referring back to FIG. 3, Suction System 13 is connected to a Flexible Tubing 19 which connects the air inlet of the Vacuum Pump 12 to Suction Tubing 17. A Tubing Guide 20 is used to guide Suction Tubing 17 when it moves in a forward and a backward directions. The forward and backward movements of Suction Tubing 17 is created either by a mechanical means or by a simple air cylinder (not shown) using the pressure difference between a vacuum and the atmospheric pressure as its driving force. A Pressure Gauge 22 which is connected to an electronic circuit (not Shown), which receives the output of the Pressure Sensor 16, is used to indicate the vacuum pressure in Cavity 5. An optional vacuum preset can be built in Pressure Gauge 22 to preset the desirable vacuum pressure prior to start generating the vacuum. The frames of both Clamp 14 and the Seal Bar 15 are rigidly connected to the Tubing Guide 20 such that the relative locations of Clamp 14 and Seal Bar 15 with respect to Tubing Guide 20 remains unchanged.

As depicted in FIG. 3, in operation, the opening of Diaphragm 4 extends to Edge Mark 24 covering a portion of Tubing Guide 20. The Diaphragm 4 and the Tubing Guide 20 are clamped from both sides by Clamp 14. A tubular Arch 33 on Clamp 14 accommodates Tubing Guide 20. An electronic switch (not shown), which is turned on by the closing of Clamp 14, opens the Vacuum Valve 26. The Suction Tubing 17, which is extended into the bag, starts to draw air out of the cavity inside the bag. When the vacuum pressure reaches the desirable level, the signal from the pressure sensor causes the withdrawing of Suction Tubing 17 through an electronic circuit and a valve (not shown). Suction Tubing 17 stops at a preset location behind the Seal Bar 15 triggering the seal bar to seal and cut Diaphragm 4. It should be noted that the sealing and the cutting are accomplished simultaneously by the seal bar. Seal Bar 15 and Clamp 14 return to their original opened positions after Diaphragm 4 is sealed and cut. The mechanical movements of Clamp 14 and Seal Bar 15 can be created either electrically or by air cylinders. It should be noted that Suction Tubing 17 could be coated with Teflon to make it easier to withdraw. It can also be lubricated with small amount of e. g. vegetable oil to reduce its surface friction.

The above automatic procedure can be replaced by a manual procedure with the same mechanical system. In the manual system, no pressure sensor, electronic circuit, electronic switches and pressure gauge are used. Instead, a timer is used to indicate the completion of a preset vacuum duration. In this case, all mechanical movements are created by manual means.

(b) A New Bag and New Procedure for Vacuum Packaging

Figure 5:
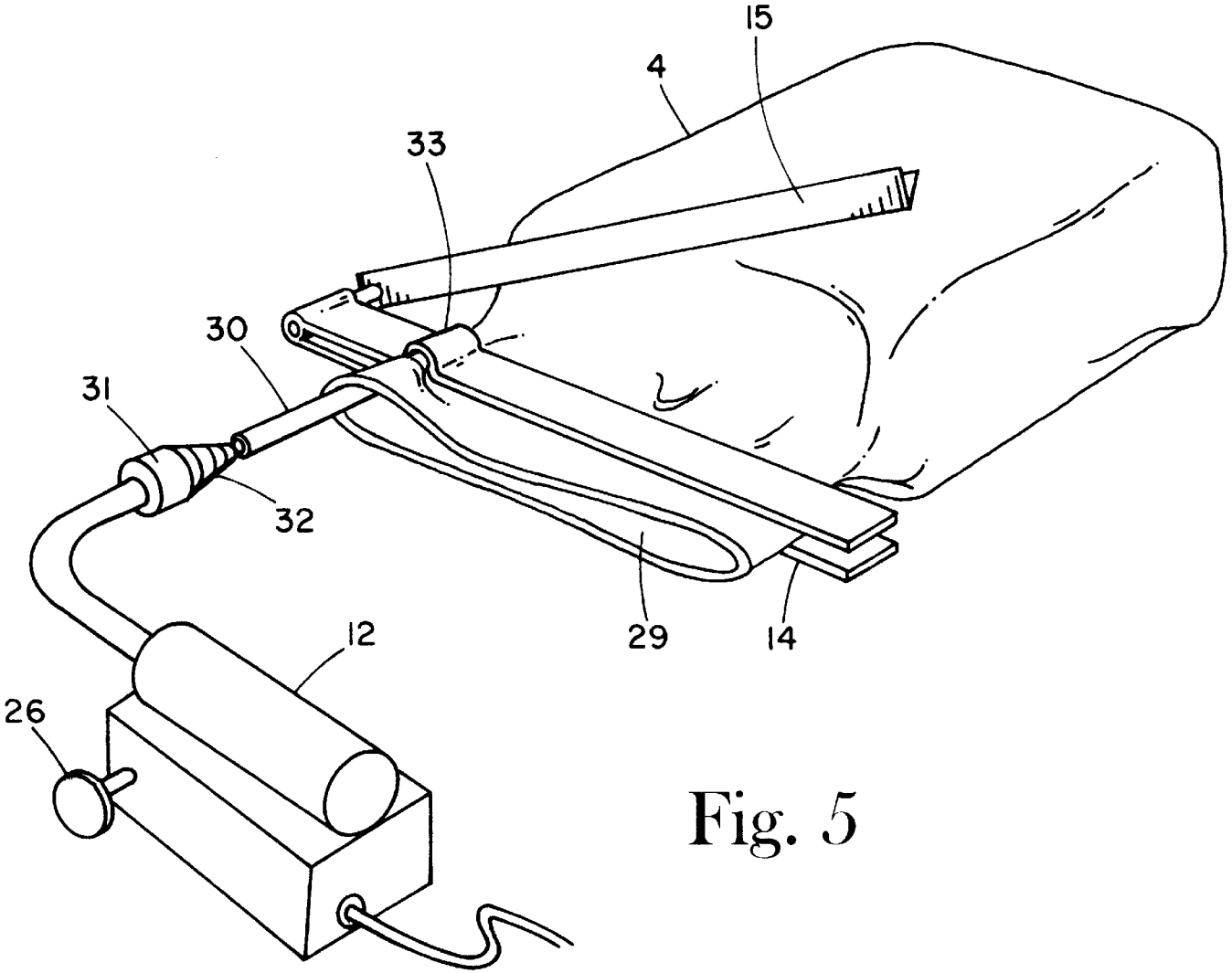
FIG. 5 is a view similar to FIG. 3 but showing alternative devices.

With reference to FIG. 5 , the Diaphragm 4 is a plastic bag made of an airtight plastic sheet or made of multiple layers of plastic sheets with different properties including the air-barrier characteristics. The plastic bag covers the package frame, or it covers both the package frame and the insulating enclosure as described in Section (1) with its Opening 29 unsealed. A plastic Tubing 30 feeds through Opening 29 and reaches the inside of the bag. Although Tubing 30 can be placed at any location of Opening 29, a preferred location, however, is at the end of the opening as depicted. It is also, as an option, that Tubing 30 is pre-glued to the bag at one end of the opening. A tube Adapter 31 is connected to a vacuum reservoir or a Vacuum Pump 12 through a flexible or a rigid tubing. The Adapter has a cone-shaped Tip 32 at the opening which can fit different diameter Tubing 30. In operation, Tubing 30 and Adapter 31 are connected before Vacuum Valve 26 is opened. After Valve 26 is opened, the air is drawn out of the bag through Tubing 30 while both Opening 29 and Tubing 30 are clamped by Clamp 14 from both sides of Opening 29 as shown. Clamp 14 has a tubular Arch 33 at the location of Tubing 30 to ensure that Tubing 30 is not clamped and remains opened during the vacuum process. It also serves as a guide to Tubing 30 when Tubing 30 is drawn out of the opening as one of the optional processes described below. There are two options by which the Opening 29 is sealed and cut:

(i) After the desirable vacuum is reached, Vacuum Valve 26 is closed and a Seal Bar 15 seals and cuts Opening 29 along with Tubing 30. In this option, Tubing 30 can be pre-glued to the plastic bag as mentioned above.

(ii) Tubing 30 is drawn out of Opening 29 after the desirable vacuum is reached. After Vacuum Valve 26 is closed, Seal Bar 15 seals and cuts only the plastic bag at Opening 29 while Tubing 30 remains in tubular Arch 33 behind the seal bar section. A small amount of powder or vegetable oil can be applied on Tubing 30 to reduce the friction when it is drawn out of Opening 29. In this option, Tubing 30 can be made of a non-plastic material.

It should be noted that an electronic circuitry (not shown) is used to prohibit Seal Bar 15 to seal and cut the plastic bag before Vacuum Valve 26 is closed. This provides a protection to the vacuum system from accidentally exposing to the atmospheric pressure. Also the frames of Clamp 14 and Seal Bar 15 are rigidly connected to each other for a precise positioning of the sealing and cutting. Both the plastic bag and Tubing 30 are made of the type of the plastic material which can be heat-sealed by the seal bar. It is preferable to use a relatively sharp-edged seal bar in the application described in (i) to seal and cut the relatively thick Tubing 30. Also higher electric resistance material can be used in the heating element at the section of Seal Bar 15, where Tubing 30 is located, such that it creates higher temperature at the section where Tubing 30 is to be sealed and cut.

What is claimed is:

1. The method of using a temperature-controlled package for enclosing a product, the temperature-controlled package having a means for minimizing convection proximate a frame, a means for minimizing conduction proximate the frame, a means for minimizing radiation proximate the package, and a means for maintaining the convection minimizing means around the frame, comprising:

cooling the product prior to enclosing the product in the temperature-controlled package; and shipping the product through a common carrier without using a refrigeration facility and without using an additional cold substance.

2. The method of using a temperature-controlled package for enclosing a product, the temperature-controlled package having a means for minimizing convection proximate a frame, a means for minimizing conduction proximate the frame, a means for minimizing radiation proximate the package, a means for maintaining the convection minimizing means around the frame, a pump, a tube connected to the pump at one end and within the maintaining means at the other end, and a clamp mounted around the maintaining means including a means for sealing the maintaining means, comprising:

drawing air out of the maintaining means through the tube;

ceasing the step of drawing air out of the maintaining means through the tube; and sealing and cutting the maintaining means.

* * * * *